US011814743B2

(12) United States Patent
Chen et al.

(10) Patent No.: US 11,814,743 B2
(45) Date of Patent: Nov. 14, 2023

(54) PLATING MEMBRANE

(71) Applicant: Taiwan Semiconductor Manufacturing Company Limited, Hsinchu (TW)

(72) Inventors: Yung-Hsiang Chen, Tainan (TW); Hung-San Lu, Kaohsiung (TW); Ting-Ying Wu, Tainan (TW); Chuang Chihchous, Fongshan (TW); Yu-Lung Yeh, Kaohsiung (TW)

(73) Assignee: Taiwan Semiconductor Manufacturing Company, Ltd., Hsinchu (TW)

( * ) Notice: Subject to any disclaimer, the term of this patent is extended or adjusted under 35 U.S.C. 154(b) by 36 days.

(21) Appl. No.: 16/901,716

(22) Filed: Jun. 15, 2020

(65) Prior Publication Data

US 2021/0388523 A1 Dec. 16, 2021

(51) Int. Cl.

| | |
|---|---|
| ***C25D 17/06*** | (2006.01) |
| ***C25D 7/12*** | (2006.01) |
| ***C25D 17/00*** | (2006.01) |

(52) U.S. Cl.

CPC ..... *C25D 17/06* (2013.01); *C25D 7/12* (2013.01); *C25D 17/001* (2013.01); *C25D 17/002* (2013.01)

(58) Field of Classification Search

CPC ..... C25D 17/002; C25D 7/12–123; H01L 21/2885; H01L 21/76873

See application file for complete search history.

(56) References Cited

U.S. PATENT DOCUMENTS

| | | | | |
|---|---|---|---|---|
| 8,262,871 | B1 * | 9/2012 | Mayer | C25D 5/08 204/263 |
| 2006/0000704 | A1 * | 1/2006 | Sato | C25D 17/001 204/192.1 |
| 2007/0246350 | A1 * | 10/2007 | Togashi | H01L 21/2885 204/237 |
| 2015/0122658 | A1 * | 5/2015 | Kim | C25D 17/002 204/252 |
| 2018/0061761 | A1 * | 3/2018 | Briggs | H01L 23/5226 |

* cited by examiner

*Primary Examiner* — Hosung Chung

(74) *Attorney, Agent, or Firm* — Harrity & Harrity, LLP

(57) ABSTRACT

A plating membrane includes a support structure extending radially outward from a nozzle that is to direct a flow of a plating solution toward a wafer. The plating membrane also includes a frame, supported by the support structure, having an inner wall that is angled outward from the nozzle. The outward angle of the inner wall relative to the nozzle directs a flow of plating solution from the nozzle in a manner that increases uniformity of the flow of the plating solution toward the wafer, reduces the amount of plating solution that is redirected inward toward the center of the plating membrane, reduces plating material voids in trenches of the wafer (e.g., high aspect ratio trenches), and/or the like.

20 Claims, 8 Drawing Sheets

PLATING MEMBRANE

BACKGROUND

Plating, and particularly electroplating, is a process by which conductive structures are formed on a semiconductor wafer. Plating may include applying a voltage across an anode formed of a plating material and a cathode (e.g., a semiconductor wafer). The voltage causes a current to oxidize the anode, which causes the release of plating material ions from the anode. These plating material ions form a plating solution that travels through a plating bath toward the semiconductor wafer. The plating solution reaches the semiconductor wafer and deposits plating material ions into trenches, vias, interconnects, and/or other structures in and/or on the semiconductor wafer.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1A:
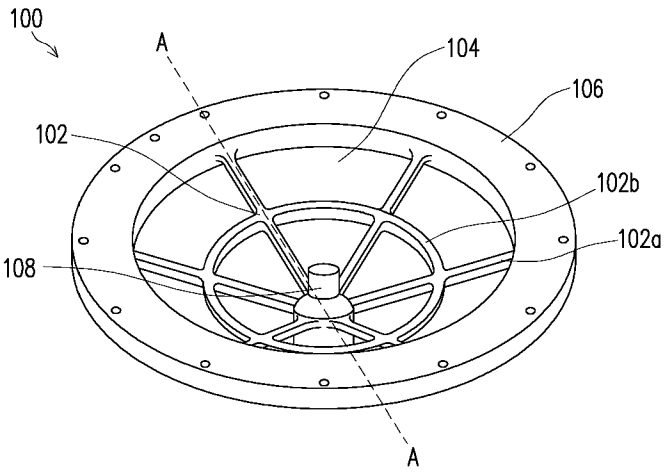
FIGS. 1A and 1B are diagrams of an example plating membrane described herein.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

In some cases, a plating tool (e.g., a tool that is used to plate semiconductor wafers) may include a plating membrane. The plating membrane may be used to reduce and/or prevent additives in a plating solution from reaching an anode. While additives may be used to improve the plating process, additives that reach the anode may react with the anode and cause the formation of undesirable byproducts in the plating solution. The plating membrane may include a filter that permits the passage of plating material but prevents passage of additives. Accordingly, the filter of the plating membrane may be used to reduce and/or prevent additives from reaching the anode while still permitting plating material from the anode to pass through the plating membrane and plate the wafer.

However, the plating membrane may cause disruptions in the flow of the plating solution from a nozzle that directs the flow of the plating solution toward the wafer. For example, the plating membrane may cause turbulence in the flow, which can decrease the ability of the nozzle to direct the flow of the plating solution toward the wafer. As a result, the plating solution may be unable to penetrate into structures (particularly, deep and/or high aspect-ratio structures) in and/or on the wafer, which can cause voids in these structures. These voids can cause decreased conductivity, decreased reliability, and/or decreases in other electrical performance characteristics.

Some implementations described herein provide a plating membrane that includes a frame having an inner wall that is angled outward from a plating tool nozzle. The outward angle of the inner wall relative to the nozzle directs a flow of plating solution from the nozzle in a manner that increases uniformity of the flow of the plating solution toward a wafer, reduces the amount of plating solution that is redirected inward toward the center of the plating membrane, reduces plating material voids in trenches, vias, interconnects, and/or other structures in and/or on the wafer.

Figure 1B:
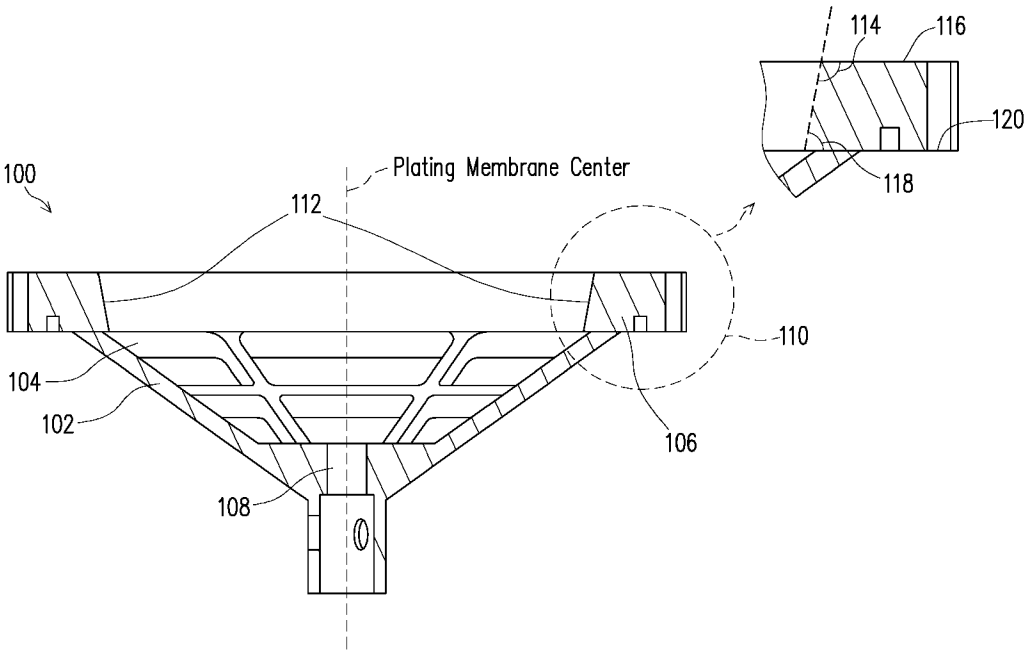

FIGS. 1A and 1B are diagrams of an example plating membrane 100 described herein. FIG. 1A illustrates a perspective view of plating membrane 100. FIG. 1B illustrates a cross-sectional view along line AA shown in FIG. 1A. In some implementations, plating membrane 100 is for use in a plating tool, such as a plating tool for plating wafers (e.g., semiconductor wafers, insulating wafers, and/or the like). The plating tool may include various types of plating tools, such as a copper electroplating tool, an aluminum electroplating tool, a nickel electroplating tool, a tin electroplating tool, a compound material or alloy (e.g., tin-silver, tin-lead, and/or the like) electroplating tool, and/or an electroplating tool for one or more other types of conductive materials, metals, and/or the like. Plating membrane 100 may be used to permit passage of plating material from an anode of the plating tool such that the plating material may reach and plate a wafer, while reducing and/or preventing passage of plating solution additives that would otherwise reach the anode and cause the formation of byproducts and/or contaminants.

As shown in FIG. 1A, plating membrane 100 may include a support structure 102 to hold or otherwise support a filter 104 and a frame 106. In some implementations, support structure 102 includes a plurality of support members 102*a* and one or more support rings 102*b*. However, the configuration of support structure 102 as illustrated in FIG. 1A is an example, and support structure 102 may constructed in other various configurations to support filter 104 and/or frame 106.

As further shown in FIG. 1A, in some implementations, plating membrane 100 may be circular (or substantially circular) shaped, and a nozzle 108 of the plating tool may be located at the center (or substantially at the center) of plating membrane 100 to evenly direct and/or guide a flow of plating solution from nozzle 108 about the circumference of plating membrane 100. In these cases, support members 102*a* may extend radially outward from a center of plating membrane 100 and/or from nozzle 108. Support members 102*a* may attach or connect to nozzle 108 at a first end to secure plating membrane 100 in place. Support members 102*a* may also attach or connect to, or may be integrated with, frame 106 at a second opposing end to hold and/or provide support to frame 106. Support members 102*a* may be located at various locations about the circumference of plating membrane 100. Support members 102*a* may be evenly and/or unevenly spaced about the circumference of plating membrane 100. Support ring(s) 102*b* may be attached to or integrated with support members 102*a* to provide support and/or rigidity to support members 102*a* against rotational forces applied to plating membrane 100 and to reduce bending of support members 102*a*.

In some implementations, plating membrane 100 may be other various shapes, such as oval shaped, square shaped, rectangular shaped, non-uniform shaped, non-standard shaped, and/or the like, and support structure 102 may be configured accordingly to support filter 104 and frame 106. In some implementations, support structure may be integrated with nozzle 108 such that plating membrane 100 and nozzle 108 are a single part or component. In some implementations, support structure 102 may be referred to as a skeleton, a web, or another type of structure that is capable of supporting filter 104 and/or frame 106.

Filter 104 includes a semi-permeable membrane or another type of filter that is capable of permitting the flow of the plating material through filter 104 while filtering, reducing, and/or preventing the flow of plating solution additives through filter 104. Filter 104 may be positioned such that filter 104 is capable of filtering plating solution that flows through the area between nozzle 108 and frame 106. In some implementations, filter 104 is attached to a bottom side or underside of support structure 102. In some implementations, filter 104 is attached to a top side or upper side of support structure 102. In some implementations, filter 104 includes a plurality of filter elements positioned in open areas of support structure 102 formed between support members 102*a* and/or support ring(s) 102*b*. In some implementations, filter 104 is attached to a bottom side or underside of support structure 102. In some implementations, filter 104 is integrated with support structure 102 such that filter 104 and support structure 102 are a single and/or unified part.

Frame 106 may be circular or substantially circular (or ring) shaped so as to provide an even flow path of plating material dispensed from nozzle 108. Frame 106 may further provide support and/or rigidity to plating membrane 100, which may increase the strength of plating membrane 100. Further, frame 106 may provide an attachment point for plating membrane 100 to be attached or connected to a wall of the plating tool to prevent movement of plating membrane 100.

Plating membrane 100, and/or support structure 102, filter 104, and frame 106 included therein, may be formed of various materials. The material(s) of plating membrane 100, and/or support structure 102, filter 104, and frame 106 included therein, may be selected so as to provide strength and and/or rigidity to plating membrane 100, to meet and/or increase reliability and longevity requirements, to reduce and/or minimize negative or undesirable reactions with intended use plating materials and/or additives, and/or the like.

As shown in the cross-sectional view in FIG. 1B, frame 106 may include an inner wall 112. If frame 106 is circular or substantially circular, inner wall 112 may extend along the circumference (e.g., the inner circumference) of frame 106. As further shown in FIG. 1B, inner wall 112 may be angled. In particular, inner wall 112 may be angled outward and away from the center of plating membrane 100 and/or nozzle 108. The outward angle away from the center of plating membrane 100 and/or nozzle 108 may direct the flow of plating solution from nozzle 108 radially outward from the center of plating membrane 100 and/or nozzle 108 and toward a wafer that is to be plated. Inner wall 112 may be angled outward and away from the center of plating membrane 100 and/or nozzle 108 along the circumference (e.g., the inner circumference) of frame 106 in a uniform manner (e.g., at a substantially uniform angle) to increase the uniformity of flow of plating solution radially outward from the center of plating membrane 100 and/or nozzle 108, and to increase the uniformity of flow of plating solution toward a wafer that is to be plated. Moreover, inner wall 112 may be angled outward and away from the center of plating membrane 100 and/or nozzle 108 to reduce the amount of plating solution that is redirected by inner wall 112 inward toward the center of plating membrane 100 and/or nozzle 108. In some implementations, inner wall 112 is angled outward and away from the center of plating membrane 100 and/or nozzle 108 to eliminate the redirection of plating solution by inner wall 112 inward toward the center of plating membrane 100 and/or nozzle 108.

In some implementations, the outward angle of inner wall 112 may be defined or identified from various reference points of plating membrane 100. For example, the angle of inner wall 112 may be defined relative to the center of plating membrane 100. In these cases, the outward angle of inner wall 112 may be greater than 0° and less than 90°. As another example, and as illustrated in a closeup view 110 in FIG. 1B, the outward angle of inner wall 112 may be defined based on an angle 114 between an upper (or top) surface 116 of frame 106. In these cases, angle 114 may be greater than 90° and less than 180°. As another example, and as illustrated in closeup view 110, the outward angle of inner wall 112 may be defined based on an angle 118 between a lower (or bottom) surface 120 of frame 106. In these cases, angle 118 may be greater than 0° and less than 90°.

In this way, plating membrane 100 includes frame 106 having inner wall 112 that is angled outward and away from a nozzle 108 and/or a center of plating membrane 100. The outward angle of inner wall 112 relative to nozzle 108 directs a flow of plating solution from nozzle 108 in a manner that increases uniformity of the flow of the plating solution toward a wafer, reduces the amount of plating solution that is redirected inward toward the center of plating membrane 100, and/or reduces plating material voids in trenches, vias, interconnects, and/or other structures in and/or on the wafer.

As indicated above, FIGS. 1A and 1B are provided as one or more examples. Other examples may differ from what is described with regard to FIGS. 1A and 1B.

Figure 2:
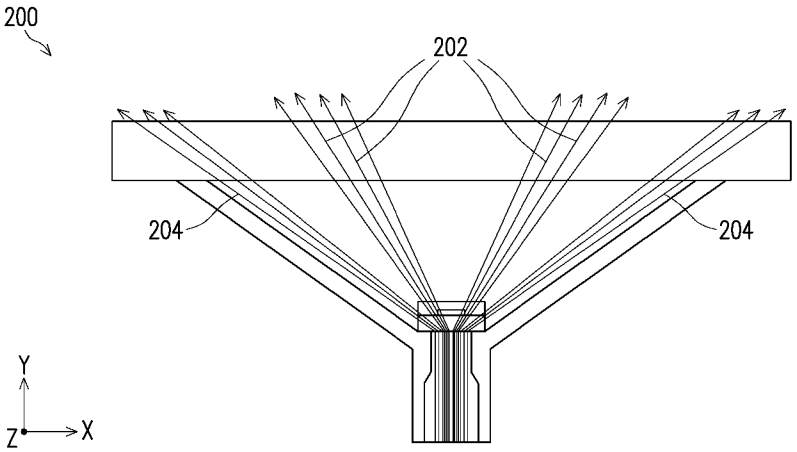
FIG. 2 is a diagram illustrating an example flow pattern of a plating solution using the example plating membrane of FIGS. 1A and 1B.

FIG. 2 illustrates an example flow pattern 200 of a plating solution using the example plating membrane 100 illustrated and described above in connection with FIGS. 1A and 1B. In some implementations, a similar uniformity of flow may be achieved using other example plating membranes having a frame with inner wall angled outward and/or away from the centers of the other example plating membranes.

Example flow pattern 200 illustrates an example flow of plating solution from a nozzle of a plating tool toward a wafer that is to be plated. As shown in FIG. 2, the flow of plating solution may include an inner portion 202 and an outer portion 204. Inner portion 202 may be directed toward the wafer without interacting with inner wall 112 of frame 106 of plating membrane 100. Conversely, outer portion 204 may be directed toward the wafer by inner wall 112.

As further shown in FIG. 2, the outward angle of inner wall 112 away from the center of plating membrane 100 increases the uniformity of flow of outer portion 204 radially outward from the center of plating membrane 100. Moreover, as further shown in FIG. 2, the outward angle of inner wall 112 away from the center of plating membrane 100 increases the uniformity of flow of inner portion 202 and outer portion 204 toward a wafer that is to be plated. In particular, the outward angle of inner wall 112 away from the center of plating membrane 100 increases the uniformity of flow of inner portion 202 by reducing and/or eliminating the amount of plating solution that is redirected by inner wall 112 inward toward the center of plating membrane 100.

As indicated above, FIG. 2 is provided as an example. Other examples may differ from what is described with regard to FIG. 2.

Figure 3:
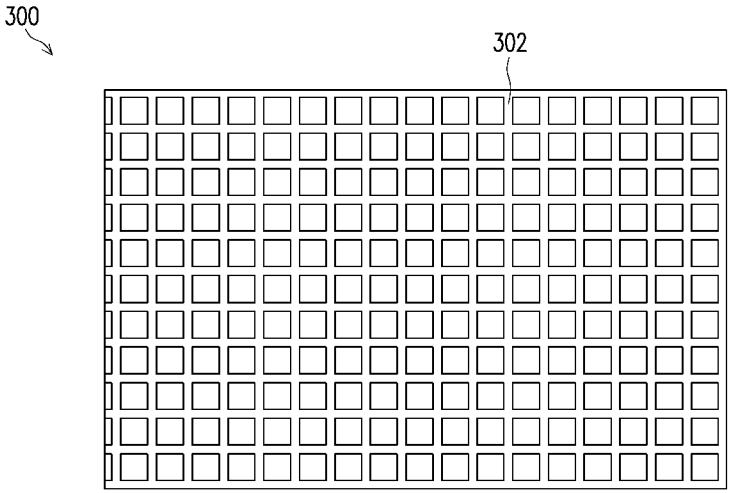
FIG. 3 is a diagram illustrating an example portion of a wafer including a plurality of plated structures.

FIG. 3 illustrates an example portion 300 a wafer including a plurality of plated structures 302 that were plated using the example plating membrane 100 illustrated and described above in connection with FIGS. 1A and 1B. In some implementations, a similar uniformity of plating may be achieved using other example plating membranes having a frame with inner wall angled outward and/or away from the centers of the other example plating membranes.

As shown in FIG. 3, plated structures 302 are evenly colored and have a uniform contrast in portion 300. This indicates that plated structures 302 are substantially absent of voids. In some implementations, the outward angle of inner wall 112 away from the center of plating membrane 100 permits plating solution to travel deep into plated structures 302 to deposit plating material within plated structures 302 such that voids (e.g., pockets devoid of plating material) in plated structures 302 do not occur. In some implementations, plated structures 302 include trenches, vias, interconnects, and/or other structures formed on and/or in portion 300 of the wafer. In some implementations, plated structures 302 includes high aspect ratio trenches, which may include trenches having an aspect ratio greater than 5 (e.g., trenches having a depth or height greater than 5 times the width of the trenches).

As indicated above, FIG. 3 is provided as an example. Other examples may differ from what is described with regard to FIG. 3.

Figure 4A:
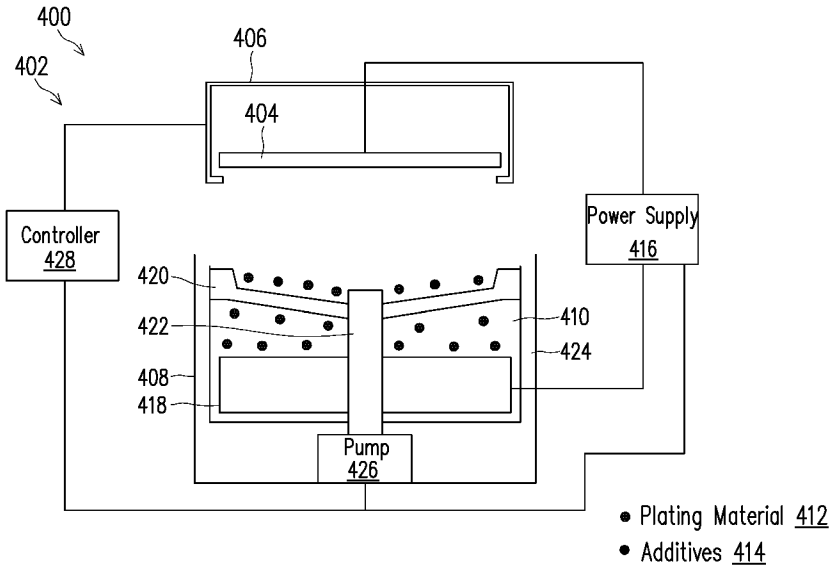
FIGS. 4A and 4B are diagrams of an example environment in which systems and/or methods described herein may be implemented.
Figure 4B:
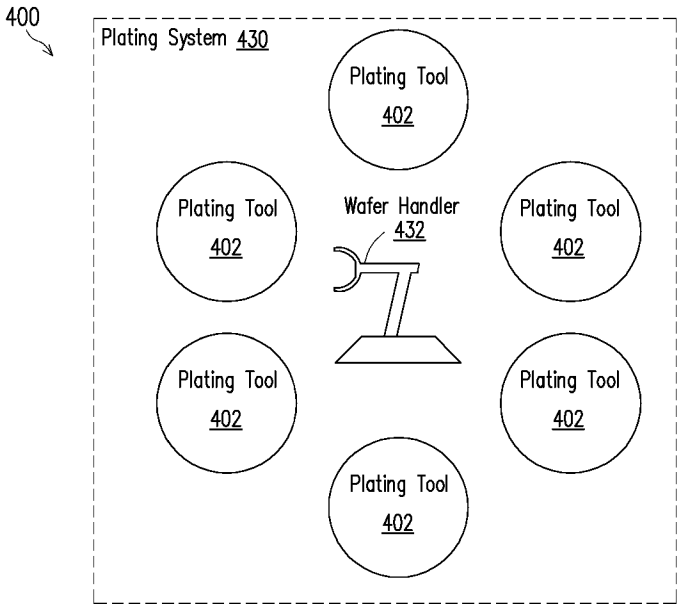

FIGS. 4A and 4B are diagrams of an example environment 400 in which systems and/or methods described herein may be implemented. As shown in FIGS. 4A and 4B, environment 400 may include a plating tool 402, a plating system 430, and/or the like. Devices and/or systems of environment 400 may interconnect via wired connections, wireless connections, or a combination of wired and wireless connections.

A plating tool 402 may include a tool that plates a wafer 404 (e.g., a semiconductor wafer, an insulating wafer, and/or another type of wafer). As shown in FIG. 4A, a plating tool 402 includes a wafer holder 406, a plating bath 408, a power supply 416, an anode 418, a plating membrane 420, a nozzle 422, one or more return lines 424, a pump 426, and a controller 428. Wafer holder 406 is capable of holding wafer 404 during a plating process. In some implementations, wafer holder 406 may lower wafer 404 into plating bath 408, which may be a chamber that is filled with a plating solution 410. Plating solution 410 may be a liquid containing plating material 412 and one or more additives 414. Power supply 416 may be a direct current (DC) power supply that is connected to anode 418 and wafer 404 via leads and may apply a voltage across anode 418 and wafer 404 to cause anode 418 to be oxidized and to release plating material 412 into plating solution 410.

Plating material 412 and anode 418 include various types of conductive materials, metals, and/or the like. For example, plating material 412 and anode 418 may include copper, aluminum, nickel, tin, tin-lead, tin-silver, and/or another type of material. Additives 414 include various types of levelers, brighteners or accelerators, inhibitors, suppressors, enhancers, and/or other types of organic and/or inorganic additives that may be used to increase or decrease deposition rates of plating material 412 on wafer 404, reduce surface roughness of plating material 412 deposited onto wafer 404, and/or the like.

Plating membrane 420 may include plating membrane 100 illustrated and described above in connection with FIGS. 1A and 1B and/or another plating membrane including a frame with an inner wall angled away from a center of the plating membrane. Plating membrane 420 may reduce and/or prevent additives 414 from traveling through plating solution 410 and reaching anode 418 while still permitting plating material 412 released from anode 418 to travel toward wafer 404.

Nozzle 422 includes an elongated cylindrical structure or another type of elongated structure to direct the flow of plating solution 410 toward wafer 404. In some implementations, nozzle 422 may dispense plating solution 410 provided via return line(s) 424. In this way, plating solution 410 may be circulated through plating bath 408 and reused. Pump 426 includes any one of various types of pumps that are capable of pumping a liquid from return line(s) 424 and through nozzle 422.

Controller 428 may include a processor, a computer (e.g., a desktop computer, a laptop computer, a tablet computer, a server, and/or the like), and/or another device capable of controlling various devices and/or components of plating tool 402. For example, controller 428 may be connected to power supply 416, and is capable of causing power supply 416 to apply a voltage across anode 418 and wafer 404, is capable of causing power supply 416 to stop applying a voltage across anode 418 and wafer 404, is capable of changing the voltage applied by power supply 416, and/or the like.

As another example, controller 428 may be connected to pump 426 and may cause pump 426 to pump plating solution 410 from return line(s) 424 to nozzle 422, may cause pump 426 to stop pumping plating solution 410, may adjust the speed or rate at which plating solution 410 is pumped through nozzle 422, and/or the like. As another example, controller 428 may be connected to wafer holder 406 and may cause wafer holder 406 to lower wafer 404 into plating bath 408, may case wafer holder 406 to rotate wafer 404 while wafer 404 is at least partially submerged in plating bath 408 (e.g., to increase the coverage and uniformity of plating material 412 on wafer 404), may cause wafer holder 406 to raise wafer 404 out of plating bath 408, and/or the like.

As shown in FIG. 4B, plating system 430 includes a plurality of plating tools 402. Each plating tool 402 may be configured to plate wafer 404 with a particular plating material 412. In some implementations, each plating tool 402 is configured to plate wafer 404 with a different plating material 412. For example, a first plating tool 402 may be configured to plate wafer 404 with copper, a second plating tool 402 may be configured to plate wafer 404 with nickel, and so on. In some implementations, one or more plating tools 402 may be configured to plate wafers with the same plating material 412 to increase the throughput of plating system 430.

In some implementations, each plating tool 402 may include devices and/or components illustrated in FIG. 4A. In some implementations, the plating tools 402 included in plating system 430 may share one or more of the devices and/or components illustrated in FIG. 4A. For example, plating system 430 may include a power supply 416 that applies voltages to a plurality of plating tools 402 included in plating system 430. As another example, plating system 430 includes a controller 428 that controls a plurality of plating tools 402 and/or wafer handler 432.

As further shown in FIG. 4B, plating system 430 includes a wafer handler 432. Wafer handler 432 may include a robotic arm or another type of device that is capable of handling wafer 404, capable of transporting wafer 404 between a wafer lot holder to a plating tool 402, capable of transporting wafer 404 from one plating tool 402 to another plating tool 402, and/or the like.

The number and arrangement of devices and networks shown in FIGS. 4A and 4B are provided as one or more examples. In practice, there may be additional devices and/or systems, fewer devices and/or systems, different devices and/or systems, or differently arranged devices and/or systems than those shown in FIGS. 4A and/or 4B. Furthermore, two or more devices and/or systems shown in FIGS. 4A and/or 4B may be implemented within a single device and/or system, or a single device and/or system shown in FIGS. 4A and/or 4B may be implemented as multiple, distributed devices and/or systems. Additionally, or alternatively, a set of devices and/or systems (e.g., one or more devices, one or more systems, and/or the like) of environment 400 may perform one or more functions described as being performed by another set of devices and/or systems of environment 400.

Figure 5:
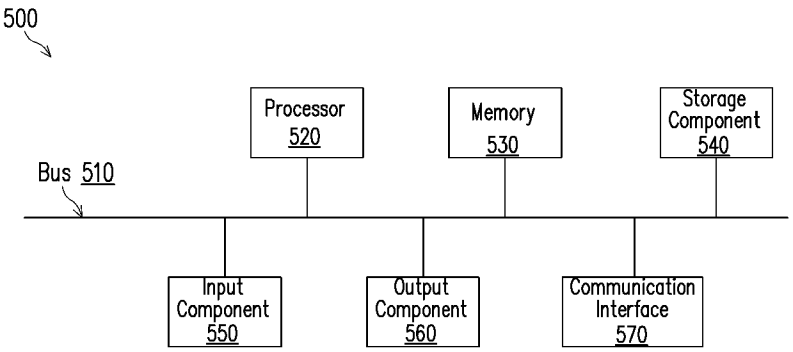
FIG. 5 is a diagram of example components of one or more devices of FIGS. 4A and/or 4B.

FIG. 5 is a diagram of example components of a device 500. Device 500 may correspond to plating tool 402, controller 428, wafer handler 432, one or more devices included in plating system 430, and/or the like. In some implementations, plating tool 402, controller 428, wafer handler 432, one or more devices included in plating system 430, and/or the like may include one or more devices 500 and/or one or more components of device 500. As shown in FIG. 5, device 500 may include a bus 510, a processor 520, a memory 530, a storage component 540, an input component 550, an output component 560, and a communication interface 570.

Bus 510 includes a component that permits communication among multiple components of device 500. Processor 520 is implemented in hardware, firmware, and/or a combination of hardware and software. Processor 520 is a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. In some implementations, processor 520 includes one or more processors capable of being programmed to perform a function. Memory 530 includes a random access memory (RAM), a read only memory (ROM), and/or another type of dynamic or static storage device (e.g., a flash memory, a magnetic memory, and/or an optical memory) that stores information and/or instructions for use by processor 520.

Storage component 540 stores information and/or software related to the operation and use of device 500. For example, storage component 540 may include a hard disk (e.g., a magnetic disk, an optical disk, and/or a magneto-optic disk), a solid state drive (SSD), a compact disc (CD), a digital versatile disc (DVD), a floppy disk, a cartridge, a magnetic tape, and/or another type of non-transitory computer-readable medium, along with a corresponding drive.

Input component 550 includes a component that permits device 500 to receive information, such as via user input (e.g., a touch screen display, a keyboard, a keypad, a mouse, a button, a switch, and/or a microphone). Additionally, or alternatively, input component HW50 may include a component for determining location (e.g., a global positioning system (GPS) component) and/or a sensor (e.g., an accelerometer, a gyroscope, an actuator, another type of positional or environmental sensor, and/or the like). Output component 560 includes a component that provides output information from device 500 (via, e.g., a display, a speaker, a haptic feedback component, an audio or visual indicator, and/or the like).

Communication interface 570 includes a transceiver-like component (e.g., a transceiver, a separate receiver, a separate transmitter, and/or the like) that enables device 500 to communicate with other devices, such as via a wired connection, a wireless connection, or a combination of wired and wireless connections. Communication interface 570 may permit device 500 to receive information from another device and/or provide information to another device. For example, communication interface 570 may include an Ethernet interface, an optical interface, a coaxial interface, an infrared interface, a radio frequency (RF) interface, a universal serial bus (USB) interface, a Wi-Fi interface, a cellular network interface, and/or the like.

Device 500 may perform one or more processes described herein. Device 500 may perform these processes based on processor 520 executing software instructions stored by a non-transitory computer-readable medium, such as memory 530 and/or storage component 540. As used herein, the term "computer-readable medium" refers to a non-transitory memory device. A memory device includes memory space within a single physical storage device or memory space spread across multiple physical storage devices.

Software instructions may be read into memory 530 and/or storage component 540 from another computer-readable medium or from another device via communication interface 570. When executed, software instructions stored in memory 530 and/or storage component 540 may cause processor 520 to perform one or more processes described herein. Additionally, or alternatively, hardware circuitry may be used in place of or in combination with software instructions to perform one or more processes described herein. Thus, implementations described herein are not limited to any specific combination of hardware circuitry and software.

The number and arrangement of components shown in FIG. 5 are provided as an example. In practice, device 500 may include additional components, fewer components, different components, or differently arranged components than those shown in FIG. 5. Additionally, or alternatively, a set of components (e.g., one or more components) of device 500 may perform one or more functions described as being performed by another set of components of device 500.

Figure 6:
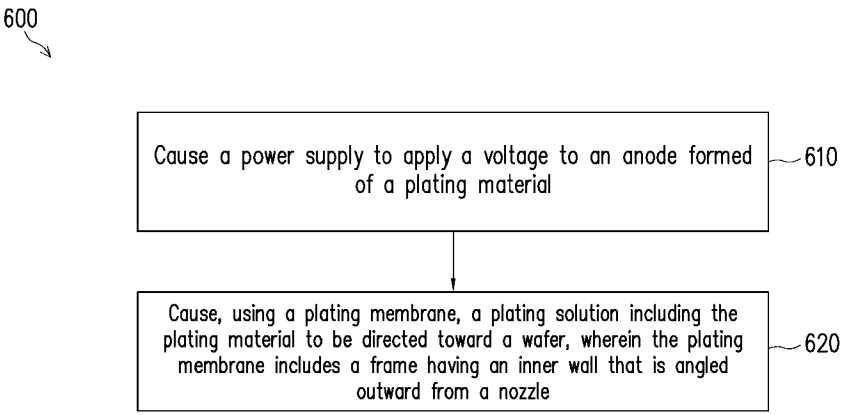
FIG. 6 is a flowchart of an example process for plating a wafer.

FIG. 6 is a flowchart of an example process 600 for plating a wafer. In some implementations, one or more process blocks of FIG. 6 may be performed by a controller of a plating tool (e.g., controller 428, device 500, and/or the like). In some implementations, one or more process blocks of FIG. 6 may be performed by another device or a group of devices separate from or including the controller, such as a power supply (e.g., power supply 416), a pump (e.g., pump 426), a wafer handler (e.g., wafer handler 432), and/or the like.

As shown in FIG. 6, process 600 may include causing a power supply to apply a voltage to an anode formed of a plating material (block 610). For example, the controller (e.g., using processor 520, memory 530, storage component 540, input component 550, output component 560, communication interface 570, and/or the like) may cause a power supply (e.g., power supply 416) to apply a voltage to an anode (e.g., anode 418) formed of a plating material (e.g., plating material 412), as described above.

As further shown in FIG. 6, process 600 may include causing, using a plating membrane, a plating solution including the plating material to be directed toward a wafer, wherein the plating membrane includes a frame having an inner wall that is angled outward from a nozzle (block 620). For example, the controller (e.g., using processor 520, memory 530, storage component 540, input component 550, output component 560, communication interface 570, and/or the like) may cause, using a plating membrane (e.g., plating membrane 100, plating membrane 420, and/or the like), a plating solution (e.g., plating solution 410) including the plating material to be directed toward a wafer (e.g., wafer 404), as described above. In some implementations, the plating membrane includes a frame (e.g., frame 106) having an inner wall (e.g., inner wall 112) that is angled outward from a nozzle (e.g., nozzle 108, nozzle 422, and/or the like).

Process 600 may include additional implementations, such as any single implementation or any combination of implementations described below and/or in connection with one or more other processes described elsewhere herein.

In a first implementation, the voltage applied to the anode causes oxidation of the anode, which causes plating material ions to be released from the anode. In a second implementation, alone or in combination with the first implementation, causing the plating solution to be directed toward the wafer includes causing a pump (e.g., pump 426) to cause the plating solution to flow through the nozzle and toward the wafer. In a third implementation, alone or in combination with one or more if the first or second implementations, the outward angle of the inner wall of the plating membrane directs the flow of plating solution from the nozzle in a manner that increases uniformity of the flow of the plating solution toward the wafer.

In a fourth implementation, alone or in combination with one or more if the first through third implementations, the outward angle of the inner wall of the plating membrane reduces the amount of plating solution that is redirected inward toward the center of the plating membrane. In a fifth implementation, alone or in combination with one or more if the first through fourth implementations, the outward angle of the inner wall of the plating membrane reduces plating material voids in structures (e.g., plated structures 302) of the wafer (e.g., high aspect ratio trenches). In a sixth implementation, alone or in combination with one or more if the first through fifth implementations, process 600 includes causing a wafer holder (e.g., wafer holder 406) to rotate the wafer while the wafer is at least partially submerged in the plating solution.

Although FIG. 6 shows example blocks of process 600, in some implementations, process 600 may include additional blocks, fewer blocks, different blocks, or differently arranged blocks than those depicted in FIG. 6. Additionally, or alternatively, two or more of the blocks of process 600 may be performed in parallel.

In this way, a plating membrane (e.g., plating membrane 100, plating membrane 420, and/or the like) includes a frame (e.g., frame 106) having an inner wall (e.g., inner wall 112, and/or the like) that is angled outward from a plating tool nozzle (e.g., nozzle 108, nozzle 422, and/or the like). The outward angle of the inner wall relative to the nozzle directs a flow of plating solution (e.g., plating solution 410 and/or the like) from the nozzle in a manner that increases uniformity of the flow of the plating solution toward a wafer (e.g., wafer 404 and/or the like), reduces the amount of plating solution that is redirected inward toward the center of the plating membrane, reduces plating material voids in various types of structures (e.g., plated structures 302) in and/or on the wafer, such as trenches, vias, interconnects, and/or the like.

As described in greater detail above, some implementations described herein provide a plating membrane. The plating membrane includes a support structure extending radially outward from a nozzle that is to direct a flow of a plating solution toward a wafer. The plating membrane includes a frame, supported by the support structure, having an inner wall that is angled outward from the nozzle.

As described in greater detail above, some implementations described herein provide a plating membrane. The plating membrane includes plating solution toward a wafer. The plating membrane includes a frame, supported by the support structure, having an inner wall that is angled radially outward from the nozzle to direct the flow of the plating solution radially outward from the nozzle and to reduce an amount of the plating solution that is redirected inward toward a center of the plating membrane.

As described in greater detail above, some implementations described herein provide a plating tool. The plating tool includes a nozzle and a plating membrane. The nozzle is positioned substantially at the center of the plating membrane and is to direct a flow of a plating solution in a plating bath toward a wafer. The plating membrane includes a support structure extending radially outward from the nozzle. The plating membrane includes a frame, attached to and supported by the support structure, having an inner wall that is angled away from a center of the plating membrane.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A plating membrane, comprising:
a support structure comprising:
support members connected to and extending radially outward from a nozzle located at a center of the plating membrane,
wherein the nozzle is to direct a flow of a plating solution toward a wafer, and
one or more support rings attached to the support members; and
a frame, supported by the support structure, having an inner wall that is angled outward from the nozzle,
wherein an angle of the inner wall is configured to eliminate redirection of the plating solution by the inner wall inward toward the center of the plating membrane,
wherein the inner wall extends from a bottom surface of the frame to a top surface of the frame, and
wherein the one or more support rings are located between the frame and one or more connection points of the support members and the nozzle.

2. The plating membrane of claim 1, further comprising:
a filter, supported by the support structure, to filter additives from the plating solution.

3. The plating membrane of claim 1, wherein the angle of the inner wall is configured to cause the flow of the plating solution radially outward from the nozzle to be uniform.

4. The plating membrane of claim 1, wherein the angle of the inner wall relative to an upper surface of the frame is greater than 90 degrees.

5. The plating membrane of claim 1, wherein the frame is a circular shape; and
wherein the inner wall is angled outward from the nozzle along a circumference of the frame.

6. The plating membrane of claim 1, wherein the plating solution includes a plating material comprising at least one of:
copper,
aluminum, or
nickel.

7. The plating membrane of claim 1, wherein the support structure is integrated with the nozzle such that the plating membrane and the nozzle are a single component.

8. A plating membrane, comprising:
a support structure comprising:
support members connected to and extending radially outward from a nozzle located at a center of the plating membrane,
wherein the nozzle is to direct a flow of a plating solution toward a wafer, and
one or more support rings attached to the support members; and
a frame, supported by the support structure, having an inner wall that is angled radially outward from the nozzle to:
direct the flow of the plating solution radially outward from the nozzle, and
eliminate redirection of the plating solution inward toward the center of the plating membrane,
wherein the inner wall extends from a lower surface of the frame to an upper surface of the frame, and
wherein the one or more support rings are located between the frame and one or more connection points of the support members and the nozzle.

9. The plating membrane of claim 8, wherein the inner wall is angled outward from the nozzle at an angle that is greater than 90 degrees.

10. The plating membrane of claim 8, wherein the inner wall is angled to reduce plating material voids in one or more high aspect ratio trenches of the wafer.

11. The plating membrane of claim 8, wherein the inner wall is angled to increase uniformity of the flow of the plating solution toward the wafer.

12. The plating membrane of claim 8, wherein the plating solution includes a copper plating material.

13. The plating membrane of claim 8, wherein the frame is circular; and
wherein the plating membrane further comprises:
a filter, supported by the support members, to reduce or prevent additives in the plating solution from reaching an anode.

14. The plating membrane of claim 8, wherein the frame is a circular shape; and
wherein the inner wall is angled outward from the nozzle along a circumference of the frame.

15. A plating tool, comprising:
a nozzle to direct a flow of a plating solution in a plating bath toward a wafer; and
a plating membrane, comprising:
a support structure comprising:
support members connected to and extending radially outward from the nozzle, and
one or more support rings attached to the support members; and
a frame, attached to and supported by the support structure, having an inner wall that is angled outward from the nozzle,
wherein an angle of the inner wall is configured to eliminate redirection of the plating solution by the inner wall inward toward a center of the plating membrane,
wherein the nozzle is located at the center of the plating membrane,
wherein the inner wall extends from a bottom surface of the frame to a top surface of the frame, and
wherein the one or more support rings are located between the frame and one or more connection points of the support members and the nozzle.

16. The plating tool of claim 15, wherein the frame is attached to the support structure at a first end of the support structure; and
wherein the support structure is supported by the nozzle at a second end of the support structure that is opposite the first end.

17. The plating tool of claim 15, wherein the angle of the inner wall is configured to reduce plating material voids in one or more high aspect ratio trenches of the wafer.

18. The plating tool of claim 15, wherein the angle of the inner wall is configured to increase uniformity of the flow of the plating solution toward the wafer.

19. The plating tool of claim 15, further comprising:
an anode to provide a plating material to the plating solution.

20. The plating tool of claim 19, wherein the plating membrane further comprises:
a filter, attached to the support structure, to filter additives from the plating solution to reduce or prevent the additives from reaching the anode.

* * * * *